United States Patent [19]

Grenfell et al.

[11] 4,104,058

[45] Aug. 1, 1978

[54] STEELMAKING

[75] Inventors: Hugh Willmott Grenfell; David James Bowen, both of Swansea, Wales

[73] Assignee: British Steel Corporation, London, England

[21] Appl. No.: 753,793

[22] Filed: Dec. 23, 1976

Related U.S. Application Data

[63] Continuation-in-part of Ser. No. 675,795, Apr. 12, 1976, abandoned.

[30] Foreign Application Priority Data

Apr. 11, 1975 [GB] United Kingdom ..... 15039/75

[51] Int. Cl.[2] ..... C21C 5/30

[52] U.S. Cl. ..... 75/60

[58] Field of Search ..... 75/59, 60

[56] References Cited

U.S. PATENT DOCUMENTS

| | | | |
|---|---|---|---|
| 3,708,159 | 1/1973 | De Bray | 75/60 |
| 3,773,497 | 11/1973 | Grenfell | 75/60 |

*Primary Examiner*—Peter D. Rosenberg

*Attorney, Agent, or Firm*—Bacon & Thomas

[57] ABSTRACT

A method of predicting the temperature of a molten steelmaking charge during a steelmaking refining process involving oxygen injection comprises selecting a time $t$ a charge datum temperature from which to begin monitoring the charge temperature, determining the rates $dc/dt$ and $dOs/dt$ over a time increment dt, where $dc/dt$ is the rate of decarburization and $dOs/dt$ is the rate at which oxygen enters the steelmaking slag, inserting the values of $dc/dt$ and $dOs/dt$ in the equation:

charge weight $\times$[(heat content of the charge at time $t + dt$) $-$(heat content of the charge at time t)] = $dc/dt \times$ heat of combustion of $C + dOs/dt \times$ molecular weight factor to convert O content to Fe content used in combustion $\times$ heat of combustion of Fe $- d(W.G.)/dt \times$ waste gas heat content $- d(H.L.)/dt$ where $d(W.G.)/dt$ is the rate at which waste gas is produced and $d(H.L.)/dt$ is the rate at which unaccountable heat losses occur, determining from the equation the temperature of the charge at time $t + dt$, and repeating the exercise for further time increments $dt$.

12 Claims, 3 Drawing Figures

STEELMAKING

Figure 1:
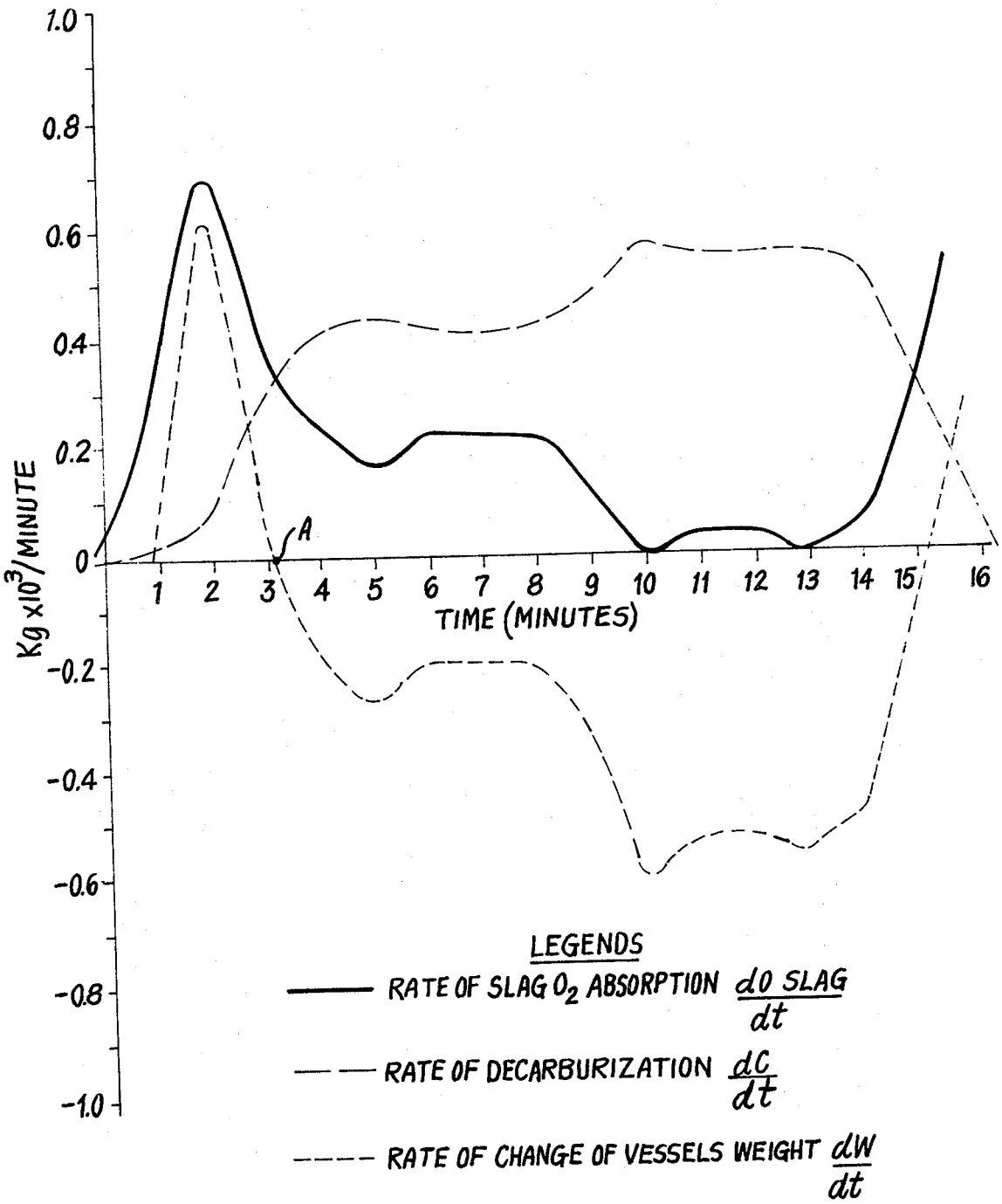

This is a continuation-in-part application of application Ser. No. 675,795, filed Apr. 12, 1976 and now abandoned.

This invention relates to the prediction of the temperature of a molten basic oxygen steelmaking charge during a steelmaking refining process involving oxygen injection and is particularly concerned with the utilization of changes in the weight of the charge during steelmaking to predict temperature.

The temperature at which molten steel is cast in the various casting processes plays an important part in the eventual quality of the finished steel product. For instance if the temperature of the molten steel is too high, it must be cooled by the addition of coolant, therefore wasting both time and coolant. On the other hand, if the temperature of the molten steel is too low, the steel must be reheated (by a re-refine of oxygen in the basic oxygen process) wasting perhaps as much as a quarter of the normal tap to tap time. In both cases a poorer quality steel usually results. In the case of rimming steels, if the casting temperature is too low, gases evolve from the steel during and after casting, so producing a porous ingot. On the other hand, if the molten steel is too hot, the steel sinks during solidification and a so-called "pipe" forms.

The teeming and/or casting temperature is of course itself controlled by the temperature of the molten steelmaking charge at the end of refining and while the desired end-point temperature necessary to avoid the above defects is generally well known for each particular grade and type of steel, the methods available to determine it are either too slow, inaccurate or are expensive in maintenance. For instance, if a bomb thermocouple is used to take the temperature of the molten steel, oxygen injection must be stopped to enable the thermocouple to be placed into the melt. On the other hand, radiation pyrometers tend to give inaccurate temperature readings because of the presence of dust particles in the atmosphere. They also require a great deal of maintenance.

It is therefore an object of the present invention to provide a method whereby the refining of the molten steel can be ceased when the required temperature has been reached in a manner overcoming the above mentioned disadvantages.

According to one aspect of the present invention, a method of predicting the temperature of a molten steelmaking charge during a steelmaking refining process involving oxygen injection comprises selecting at time t a charge datum temperature from which to begin monitoring the charge temperature, determining the rates $dC/dt$ and $dOs/dt$ over a time increment dt, where $dC/dt$ is the rate of decarburisation and $dOs/dt$ is the rate at which oxygen enters the steelmaking slag, inserting the values of $dC/dt$ and $dOs/dt$ in the equation charge weight × [(heat content of the charge at time $t$ × $dt$) − (heat content of the charge at time $t$)] = $dC/dt$ × heat of combustion of $C$ + $dOs/dt$ × molecular weight factor to convert O content to Fe content used in combustion × heat of combustion of Fe − $d(W.G.)/dt$ × waste gas heat content − $d(H.L.)/dt$ where $d(W.G.)/dt$ is the rate at which gas is produced and $d(H.L.)/dt$ is the rate at which unaccountable heat losses occur, determining from the equation the temperature of the charge at time $t + dt$, and repeating the exercise for further time increments $dt$.

Preferably $dC/dt$ and $dOs/dt$ are determined by measuring $dW/dt$ where $dW/dt$ is the weight change of the charge in time increment $dt$. In this case $dC$ may be calculated from the equation $$dC/dt = [(dOt/dt) - (dW/dt)]/2.33$$

where $dOt/dt$ is the rate at which oxygen is being supplied to the charge and 2.33 is the ratio molecular weight CO: molecular weight C. In a preferred embodiment $dC/dt$ is corrected by subtracting from it the rate of fume loss in time increment dt. $dOs/dt$ is suitably calculated from the equation $$dOs/dt = dW/dt + dC/dt$$

where $dC/dt$ is uncorrected for fume loss.

Preferably time t represents the point at which slagmaking is complete and decarburisation is initiated. This point is suitably represented by the point where $dW/dt$ is zero.

$d(W.G.)/dt$ is conveniently calculated from the uncorrected value of $dC/dt$.

Figure 2:
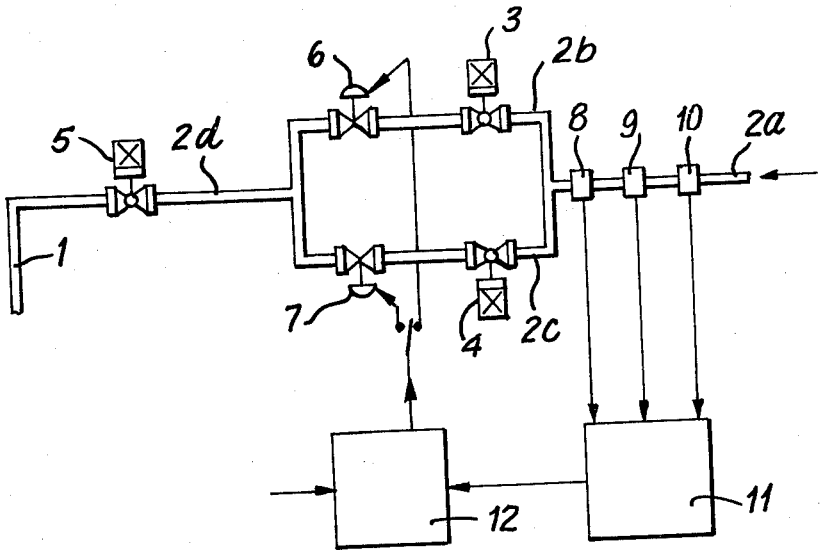
Figure 3:
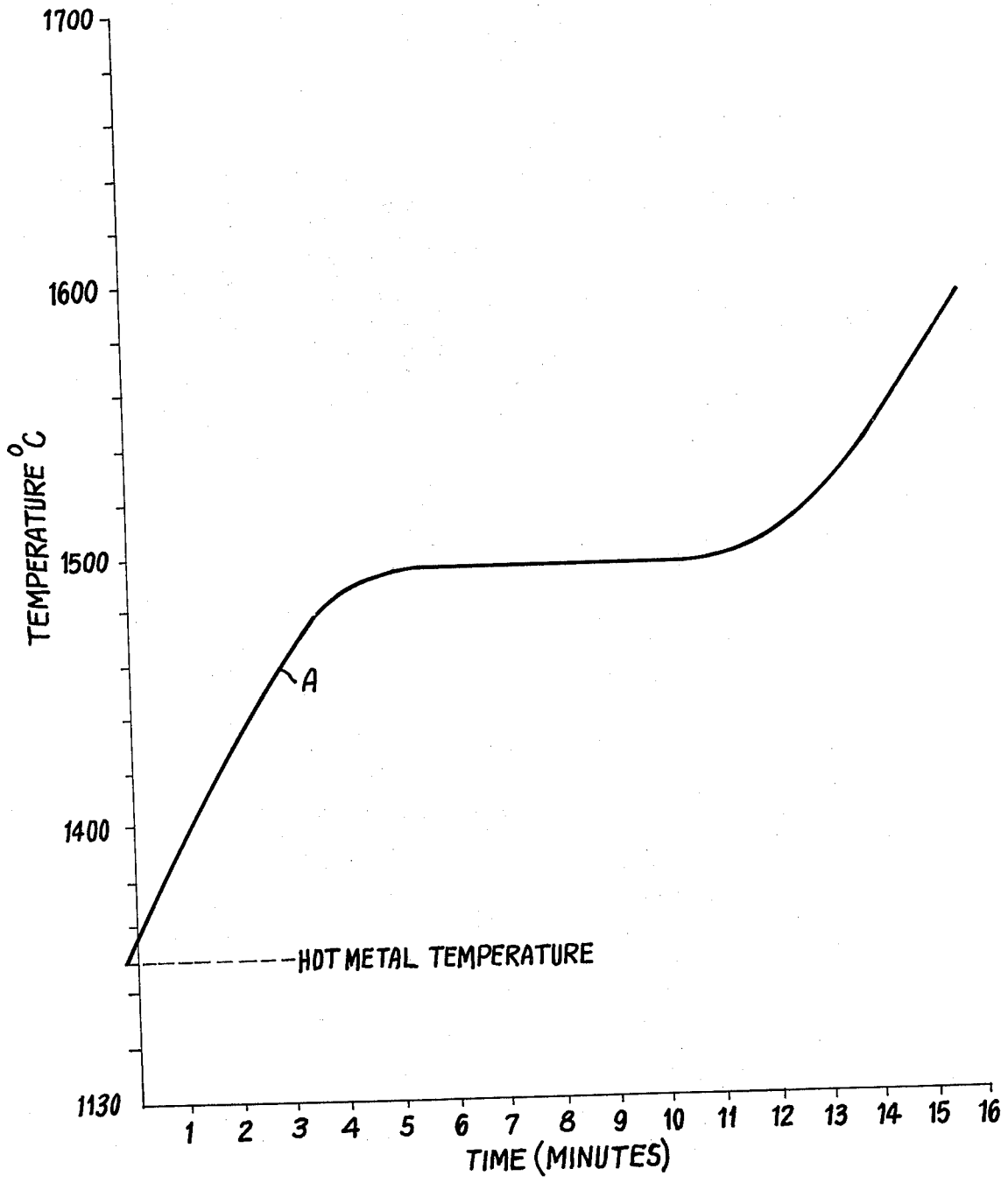

An embodiment of the invention will now be particularly described with reference to the accompanying drawings in which:

FIG. 1 is a graph showing the variations in $dC/dt$, $dOs/dt$ and $dW/dt$ with time during steelmaking and FIG. 2 shows the equipment necessary to control and monitor the flow of oxygen in order to determine $dOt/dt$ and therefrom $dOs/dt$ and FIG. 3 is a graph of predicted temperature rise against time during steelmaking.

For simplicity in the description the equation:

charge weight × [(heat content of charge at time $t$ + $dt$) − (heat content of charge at time $t$)] = $dC/dt$ × heat of combustion of $C$ + $dOs/dt$ × moleculer weight factor to convert O content to Fe content used in combustion × heat of combustion of Fe − $d(W.G.)/dt$ × waste gas heat content − $d(H.L.)/dt$ will be referred to as equation (1).

The various components in equation (1) will be discussed to show how equation (1) should be used.

(1) Charge Weight

The charge weight in Kg at any particular time during steelmaking in a BOS vessel can be established by simply subtracting the known weight of the vessel from the total weight of the vessel. The vessel may be weighed in the well known manner by means of load cells as for instance described in U.S. Pat. No. 3,773,497 incorporated herein by reference. Thus for any increment of time $dt$, and conveniently during steelmaking 6 seconds is found to be a reasonable time increment, the weight change in the charge can be determined to find $dW/dt$. In FIG. 1 the curve for $dW/dt$ is plotted for convenience as $dt$ = 1 minute throughout the steelmaking blow.

(2) Heat Content of Charge

The heat content of the charge at any particular time is calculated by utilizing the well known formula $Ms\theta$ where $M$ is the weight of the charge in Kg, $s$ is the specific heat of the charge in Joules/° C and $\theta$ is the temperature of the charge in ° C. $M_1$, $S_1$, and $\theta_1$ would then be the weight, specific heat and temperature respectively of the charge at time $t$ and $M_2$, $S_2$, $\theta_2$ would then be the weight, specific heat and temperature of the charge at time $t + dt$. $M_1$ and $M_2$ can be found by weighing, $\theta_1$ is known as, for example, by thermocouple measurements, and $S_1$ can be found from reference tables for a charge having a temperature $\theta_1$. $\theta_2$ is the temperature to be predicted and, since $\theta_2$ is unknown $S_2$ is assumed for a small time increment $dt$ to be equal to $S_1$. When established $\theta_2$ can of course be used to predict the temperature of the charge $\theta_3$ after a further time increment dt. In this case $S_2$ is corrected to its actual value at temperature $\theta_2$.

It has been noted experimentally for a hot metal charge that the temperature rise from the start of the blow, through the slag making period to the termination of the blow when decarburisation is initiated varies between 18° C and 22° C per minute. The start of decarburisation can be assumed to be the point where, if continuously plotted from the start of the blow, $dW/dt = 0$ (point A in FIG. 1). This is based on the assumption that where $dW/dt$ is positive oxygen is being absorbed into the slagmaking flux in great quantities to form $SiO_2$, MnO and FeO so that there is an overall increase in the weight of the charge and where $dW/dt$ is negative oxygen is being used to form CO and $CO_2$ which evolve from the charge so that the charge is decarburised and its overall weight diminishes. Generally speaking it takes from between 3 to 6 minutes from the start of the blow to reach the point where $dW/dt = 0$ so that if the temperature rise is assumed to be 20° C per minute the temperature at which decarburisation begins can be estimated to within ±12° C provided that the initial temperature of the hot metal is accurately known. The point where $dW/dt = 0$ is therefore a convenient point at which to start using equation (1) to predict the rise in temperature.

(3) $dC/dt$ $$dC/dt = [(dOt/dt) - (dW/dt)]/2.33 \qquad (2)$$

where 2.33 = ratio molecular weight CO/molecular weight C.

In FIG. 2, oxygen is supplied to the operating lance 1 via pipework 2a which branches into branch pipes 2b, 2c, which each contain pneumatically operated ON-OFF valves 3,4 respectively. The branch pipes 2b, 2c unify to form pipework 2d connected to lance 1, pipework 2d also being provided with an ON-OFF valve 5. Each branch pipe 2b, 2c also contains a pneumatically operated flow control valve, namely valves 6,7 respectively. Temperature, pressure and flow gauges 8,9,10 respectively measure the valves of the oxygen temperature, pressure and flow rate in pipework 2a and signals representative of these values together with a fixed value of the specific gravity of the oxygen are fed into and are processed by an analogue computer 11 to provide a calculated corrected mass oxygen flow rate. Analogue computer 11 may be, for example, model AED analogue computer manufactured by Kent Ltd., England. The calculation performed is quite straightforward, namely $P_1V_1/T_1 = P_2V_2/T_2$ where $P_2$, $V_2$, $T_2$ are measured values of pressure, volume and temperature from the gauges and $P_1$ and $T_1$ are known STP values of oxygen pressure and temperature. $V_1$ is determined by the computer and the mass oxygen flow rate is then $M_1 = V_1 \cdot D_1$ where $D_1$ is the density of oxygen at STP.

A signal representative of this flow rate is fed into controller 12 which also receives a signal representative of a demanded flow rate. The demanded flow rate is the rate of mass flow of oxygen and is determined by the amount of steel being refined, the carbon and impurity content and the length of time required for refining. The controller 12 is preprogrammed with the demanded flow rate and equalises these two rates by emitting a correction signal to one or other of the flow control valves 6,7 to open or close said valve 6 or 7. The controller 12 may be, for example, a Kent Instrument Flexel Indicating Controller LBB.

The value $dOt/dt$ at any instant can be determined from the calculated corrected oxygen flow rate.

$dC/dt$ in equation (2) contains an error due to fume coming off and a correction must be made for this. The total carbon lost during steelmaking is the integral $\int dC/dt$ and theoretically should represent the total weight loss of the charge. Similarly the integral $\int dOs/dt$ should theoretically represent the total weight gain of the charge during steelmaking.

Therefore $\int dW/dt$ should theoretically equal $\int dOs/dt - \int dC/dt$. However, it is found in practice that the total weight loss $\int dW/dt$ exceeds the theoretical weight loss by a certain amount. This additional loss has been found to be due to fume evolution. The fume is found to consist almost completely of iron oxide rising from the slag. Hence it is assumed that the rate of fume loss $d(\text{Fume})/dt$ is proportional to the rate at which iron enters the slag and this in turn is assumed to be proportional to the rate $dOs/dt$ at which oxygen enters the slag.

Therefore $$d(\text{Fume})/dt \;\alpha\; dOs/dt = K \cdot dOs/dt \qquad \text{eq. (3)}$$

$K$ is a constant which can be determined experimentally from a number of steelmaking trials.

$dC/dt$ can therefore be expressed in the foregoing corrected form:

$$dC/dt = [(dOt/dt) - (dW/dt)]/2.33 - d(\text{Fume})/dt \qquad \text{eq. (4)}$$

(4) Heat Combustion of C

In calculating the heat of combustion of C it is assumed that:

(1) The heat of combustion is in KJ/Kg
(2) For every 1 Kg C used in combustion 0.9 Kg are used to form CO and 0.1 Kg are used to form $CO_2$
(3) 1 Kg C generates 11025 KJ in forming CO
(4) 1 Kg C generates 34635 KJ in forming $CO_2$ Therefore heat of combustion of 1 Kg C
$= 0.9 \times 11025 + 0.1 \times 34635$ KJ
$= 13386.0$ KJ Heat of combustion of C
$= 13336.0$ KJ/Kg In this case $dC/dt$ is in Kg/minute.

(5) $dOs/dt$ $$dOs/dt = dW/dt + dC/dt \qquad \text{eq. (5)}$$

$dC/dt$ is calculated from equation (4)

(6) Molecular Weight Factor to Convert O content to Fe Content Used in Combustion The Fe referred to is that which combusts in the slag. This combusts to FeO and $Fe_2O_3$.

In calculating the molecular weight factor it is assumed that:

(1) Fe → 10 parts FeO + 4.5 parts $Fe_2O_3$
(2) Atomic Weight of Fe = 56
(3) Atomic Weight of O = 16
(4) Molecular Weight of FeO = 72
(5) Molecular Weight of $Fe_2O_3$ = 160

FeO

To produce 10 Kg FeO
(56/72) × 10 Kg Fe are needed
= 7.77 Kg
and (16/72) × 20 Kg O are needed
= 2.2 Kg $Fe_2O_3$ To produce 4.5 Kg $Fe_2O_3$
(112/160) × 10 Kg Fe are needed
= 3.15 Kg
and (48/160) × 4.5 Kg O are needed
= 1.35 Kg
Total amount of Fe used = 7.77 + 3.15 Kg = 10.92 Kg
Total amount of O used = 2.22 + 1.35 Kg = 3.57 Kg (7) Heat of Combustion of Fe In calculating the heat of combustion of Fe it is assumed that:

(1) The heat of combustion is in KJ/Kg
(2) 1 Kg Fe generates 5025 KJ in forming FeO
(3) 1 Kg Fe generates 7350 KJ in forming $Fe_2O_3$ Therefore heat of combustion of 7.77 Kg Fe in forming FeO
= 7.77 × 5.025 KJ
='39000 KJ
Heat of combustion of 3.15 Kg Fe in forming $Fe_2O_3$
= 3.15 × 7350 KJ
= 23200 KJ
Therefore total heat of combustion for 10.92 Kg Fe
= 39000 + 232000 KJ
= 62200 KJ
Consequently, 1 Kg O generates 62200/3.57 KJ/Kg of heat
= 17400 KJ/Kg
In this case *dOs/dt* is in Kg/minute (8) *d*(W.G.)/ *dt*

The weight of waste gas leaving the furnace in time dt can be calculated from the corrected value of *dC/dt* assuming that:

10 moles C → 9 moles CO + 1 mole $CO_2$.

(9) Waste Gas Heat Content

This can be established from the known heat contents of CO and $CO_2$ available in reference tables at various temperatures.

(10) *d*(H.L.)*dt*

There is always an unaccountable loss of useful heat during steelmaking. The heat is lost by radiation principally, but some heat is also lost by convection.

The heat loss in time increment dt can be found empirically by calculating during a trial heat both sides of equation (1) over various time increments dt from accurately measured values of the temperature $\theta$ of the charge at time $t$ and time $t + dt$.

Due to the heat loss during time increment *dt* the calculated values of the respective sides of the equation are in disagreement by a certain value *d*(H.L.)./*dt* This value can be added at the appropriate temperature to the appropriate side of the equation during further steelmaking runs. It is recalculated as the converter vessel ages as it changes with vessel wear.

It will be appreciated that the calculations of *dC/dt, dOs/dt, dW/dt, dOt/dt* and equation (1) to find $\theta$ can be performed by a suitable computer programmed for the purpose.

Referring to the Figures, FIG. 1 shows the variations occurring during refining on a 160 tonne production vessel. The curve *dW/dt* is the rate of change of weight as measured by load cells under the vessel. The curve *dC/dt* is the rate of decarburisation as calculated from *dW/dt* and the oxygen blowing rate (*dOt*)/(*dt*. Curve *dO/dt* slag (*dOs*)/(*dt*) is the rate of change of oxygen going to the slag as calculated from *dW/dt* and *dC/dt*. Point A on the curve for *dW/dt* is the point where the slag making period ends, that is where *dW/dt* = 0. All the curves were plotted for time increments (*dt*) of 1 minute.

FIG. 3 is the temperature curve calculated from equation (1). Point A is the point where decarburisation starts as shown in FIG. 1.

In FIG. 3 use was only made of equation (1) to predict the temperature of the charge after point A was reached. Up to point A the charge temperature was predicted by assuming a steady rise of between 18° to 22° C per minute in charge temperature as previously described, the hot metal temperature being accurately measured. Temperature was predicted and plotted at time increments (*dt*) of 1 minute.

For most types and grades of steel the required value of the molten steel temperature falls within the range 1595° C to 1615° C. The appropriate time at which oxygen injection is ceased would in the majority of cases fall within the range 15 to 22 minutes depending on the availability of oxygen and the speed at which oxygen is injected. FIG. 3 shows a temperature curve for a molten rimming steel which is normally cast at 1600° C. FIG. 3 shows that refining would be ceased after 16 minutes by ceasing the further injection of oxygen at this stage. The steel could then be teemed into a ladle for casting.

While not described, it will be appreciated that the invention could be applied to the prediction of temperature in the refining of non-ferrous metals such as copper and nickel.

The present invention has several advantages over prior art methods of molten steel temperature measurement. Firstly it is more rapid than using thermocouples because since temperature is continuously being predicted during oxygen refining, there is no need to stop refining at any stage. Secondly, since no equipment is placed into the molten steel, there is no need for expensive maintenance resulting from any damage sustained by the equipment. Thirdly, the present invention enables temperatures to be measured much faster than existing gas analysis methods and fourthly, temperature can be measured continuously, unlike in pyrometric methods where temperature is measured intermittently.

What we claim is:

1. A method for enabling the refining of a molten steelmaking charge to be ceased when the temperature of the steel is at a desired value, the method comprising the steps of:

(a) injecting oxygen into the molten steelmaking charge, (b) measuring the weight of the vessel at time $t$, (c) measuring the weight of the vessel at time $t + dt$, (d) measuring $dw/dt$ where $dw/dt$ is the weight change of the charge in time increment $dt$, (e) determining $dc/dt$ from the equation $dc/dt = [(dOt/dt) - (dw/dt)]/2.33$ where $dc/dt$ is the rate of decarburisation, $dOt/dt$ is the rate at which oxygen is being supplied to the charge and 2.33 is the ratio molecular weight CO: molecular weight C, (f) determining $dOs/dt$ from the equation $dOs/dt = dw/dt + dc/dt$ where $dOs/dt$ is the rate at which oxygen enters the steelmaking slag, (g) inserting the values of $dc/dt$ and $dOs/dt$ in the equation: charge weight × [(heat content of the charge at time $t + dt$) − (heat content of the charge at time $t$)] = $dc/dt$ × heat of combustion of C + $dOs/dt$ × molecular weight factor to convert O content to Fe content used in combustion × heat of combustion of Fe − $d(W.G.)/$ dt × waste gas heat content − $d(H.L.)/dt$ where $d(W.G.)/dt$ is the rate at which waste gas is produced and $d(H.L.)/dt$ is the rate at which unaccountable heat losses occur, (h) determining from the equation the temperature of the charge at time $t + dt$, (i) repeating steps (a) to (h) above for further time increments dt until the desired value of the molten steel temperature has been determined, and (j) ceasing oxygen injection at the time corresponding to the time at which the molten steel reaches the desired temperature.

2. For use in casting molten steel for enabling ceasing of oxygen flow at a desired temperature value in the refining of said molten steel, the method comprising the steps of:

(a) injecting oxygen into said molten steel, (b) measuring the weight of the vessel at time $t$, (c) measuring the weight of the vessel at time $t + dt$, (d) measuring $dw/dt$ where $dw/dt$ is the weight change of the charge in time increment $dt$, (e) determining $dc/dt$ from the equation $dc/dt = [(dOt/dt) - (dw/dt)]/2.33$ where $dc/dt$ is the rate of decarburisation, $dOt/dt$ is the rate at which oxygen is being supplied to the charge and 2.33 is the ratio molecular weight CO: molecular weight C, (f) determining $dOs/dt$ from the equation $dOs/dt = dw/dt + dc/dt$ where $dOs/dt$ is the rate at which oxygen enters the steelmaking slag, (g) inserting the values of $dc/dt$ and $dOs/dt$ in the equation: charge weight × [(heat content of the charge at time $t + dt$) − (heat content of the charge at time $t$)] = $dc/dt$ × heat of combustion of C + $dOs/dt$ × molecular weight factor to convert O content to Fe content used in combustion × heat of combustion of Fe − $d(W.G.)/dt$ × waste gas heat content − $d(H.L.)/dt$ where $d(W.G.)/dt$ is the rate at which waste gas is produced and $d(H.L.)/dt$ is the rate at which unaccountable heat losses occur, (h) determining from the equation the temperature of the change at time $t + dt$, (i) repeating steps (a) to (h) above for further time increments dt until the desired value of the molten steel temperature has been determined, and (j) ceasing oxygen injection at the time corresponding to the time at which the molten steel reaches the desired temperature.

3. A method according to claim 1 in which in step (*e*) $dc/dt$ is corrected by subtracting from it the rate of fume loss in time increment $dt$.

4. A method according to claim 1 in which in step (*f*), $dc/dt$ is uncorrected for the rate of fume loss in time increment $dt$.

5. A method according to claim 1 in which the time $t$ represents the point at which slagmaking is complete and decarburisation is initiated.

6. A method according to claim 5 in which the time $t$ is represented by the point where $dw/dt$ is 0.

7. A method according to claim 1, in which $d(.W.G)/dt$ is calculated from an uncorrected value of $dc/dt$.

8. A method according to claim 2 in which in step (*e*) $dc/dt$ is corrected by subtracting from it the rate of fume loss in time increment dt.

9. A method according to claim 2 in which in step (*f*), $dc/dt$ is uncorrected for the rate of fume loss in time increment $dt$.

10. A method according to claim 2 in which the time $t$ represents the point at which slag making is complete and decarburisation is initiated.

11. A method according to claim 10 in which the time $t$ is represented by the point where $dw/dt$ is 0.

12. A method according to claim 2 in which $d(W.G.)/dt$ is calculated from an uncorrected value of $dc/dt$.

* * * * *